US005174648A

United States Patent [19]

Clary et al.

[11] Patent Number: 5,174,648

[45] Date of Patent: Dec. 29, 1992

[54] LIGHTING FIXTURE SUPPORT ASSEMBLY

[75] Inventors: Arthur V. Clary; Bonnie J. Brohard, both of Newark; Darl E. Billingsley, Glenford, all of Ohio

[73] Assignee: Holophane Company, Inc., Newark, Ohio

[21] Appl. No.: 843,894

[22] Filed: Feb. 27, 1992

[51] Int. Cl.[5] ..... F21V 19/04

[52] U.S. Cl. ..... 362/228; 362/235; 362/249; 362/250; 362/254; 362/329; 362/363; 362/372; 362/404; 362/429

[58] Field of Search ..... 362/20, 212, 235, 228, 362/249, 250, 254, 186, 329, 363, 372, 404, 408, 416, 429, 448

[56] References Cited

U.S. PATENT DOCUMENTS

| | | | |
|---|---|---|---|
| 1,257,496 | 2/1918 | Lamb | 362/429 |
| 2,056,659 | 8/1936 | Fenwick et al. | 362/228 |
| 2,066,973 | 1/1937 | Halvorson | 362/235 |
| 2,259,107 | 8/1941 | Halvorson | 362/228 |
| 2,291,926 | 8/1942 | Sperti | 362/250 |
| 3,860,829 | 1/1975 | Fabbri | 307/66 |
| 4,171,535 | 10/1979 | Westermann | 362/406 |
| 4,199,803 | 4/1980 | Hunt, III | 362/20 |
| 4,238,815 | 12/1980 | Price | 362/218 |
| 4,368,506 | 1/1983 | Rapp | 362/147 |
| 4,407,011 | 9/1983 | Lahm | 362/150 |
| 4,419,717 | 12/1983 | Price et al. | 362/148 |
| 4,420,802 | 12/1983 | Smester et al. | 362/364 |
| 4,449,168 | 5/1984 | Ewing | 362/404 |
| 4,451,762 | 5/1984 | Forte et al. | 315/87 |
| 4,459,648 | 7/1984 | Ullman | 362/307 |
| 4,460,948 | 7/1984 | Malola | 362/396 |
| 4,498,126 | 2/1985 | Hernandez | 362/220 |
| 4,535,398 | 8/1985 | Johnson et al. | 362/404 |
| 4,709,313 | 11/1987 | Goralnik | 362/414 |
| 4,855,883 | 8/1989 | Spitz | 362/260 |
| 4,890,200 | 12/1989 | Mandy | 362/20 |
| 4,976,633 | 12/1990 | Behelli | 439/571 |
| 5,023,765 | 7/1991 | Barton | 362/429 |
| 5,073,845 | 12/1991 | Aubrey | 362/226 |

OTHER PUBLICATIONS

Holophane Industrial Lighting Products Digest HL/693.

*Primary Examiner*—Ira S. Lazarus
*Assistant Examiner*—L. Heyman
*Attorney, Agent, or Firm*—Brooks & Kushman

[57] ABSTRACT

An apparatus for supporting a primary lamp and a secondary lamp is disclosed. The apparatus comprises primary and secondary brackets, and primary and secondary sockets. The primary socket is affixed to the primary bracket, and receives the primary lamp, preferably a high intensity discharge lamp. The secondary bracket has a first end affixed to the primary bracket and a second end. The secondary socket is affixed to the secondary bracket, and receives the secondary lamp, preferably an incandescent lamp. The primary bracket defines a projected perimeter. The second end of the secondary bracket is normally biased to an operating position where the secondary lamp extends outside the projected perimeter of the primary bracket, but can be moved to a maintenance position where the secondary lamp is within the projected perimeter of the primary bracket. In operation, the secondary lamp is thus spaced apart from the primary lamp. During lamp replacement, however, the secondary bracket can be moved to a position where both lamps can be extracted from their enclosure.

13 Claims, 2 Drawing Sheets

LIGHTING FIXTURE SUPPORT ASSEMBLY

TECHNICAL FIELD

This invention relates generally to lighting fixtures, and more particularly to a support assembly for suspended lighting fixtures having primary and secondary lamps.

BACKGROUND ART

Lighting fixtures which are suspended from drop ceilings have well known applications in commercial, industrial, and institutional buildings. These lighting fixtures may include both primary lamps which are normally illuminated, and secondary lamps which can be lit in the event power is interrupted to the primary lamp. See, for example, U.S. Pat. No. 3,860,829 to Fabbri, which discloses a fluorescent lighting fixture having an auxiliary bulb for use as an emergency light. Similarly, U.S. Pat. No. 4,890,200 to Mandy discloses a down lighting system for elevators which includes standard and emergency lights. Still further, U.S. Pat. No. 4,451,762 to Forte et al. discloses a control circuit and system for providing emergency lighting from a single electrical power source.

Conventional lighting fixtures such as those referenced above have historically incorporated rigid mounting structures for the primary and secondary lamps to address known mechanical and thermal operational requirements. These structures, however, impede access to the lamps and thus hinder routine lamp replacement While openings have been designed to provide access to the lamps, such openings have tended to be too large to be aesthetically appealing—particularly in fixture designs where the primary and secondary lamps are mounted within light transmissible enclosures. In such cases, the enclosures are also not supported by the fixture during lamp replacement, thus requiring additional time and labor during maintenance.

SUMMARY OF THE INVENTION

The present invention overcomes the above-noted design problems by providing a novel assembly for supporting suspended lighting fixtures having primary and secondary lamps mounted within a light transmissible enclosure. As more fully set forth herein, the assembly comprises primary and secondary brackets, and primary and secondary sockets. The primary socket is affixed to the primary bracket, and is adapted to electrically receive the primary lamp. The secondary bracket has a first end affixed to the primary bracket and a second end affixed to the secondary socket. The secondary socket is adapted to electrically receive the secondary lamp.

In accordance with the invention, the primary bracket defines a projected perimeter. The second end of the secondary bracket is movable between an operating position wherein the secondary lamp extends outside the projected perimeter of the primary bracket and a maintenance position wherein the secondary lamp is held within the projected perimeter of the primary bracket. The secondary lamp is normally biased to the operating position such that it is spaced apart from the primary lamp in accordance with mechanical and thermal operational requirements known to those skilled in the art. During maintenance such as lamp replacement, however, the secondary bracket can be adjusted to cause its second end and thus the secondary lamp to be moved to the maintenance position such that both the primary and secondary lamps can be easily extracted from within their enclosure.

Accordingly, it is an object of the present invention to provide a support assembly for suspended lighting fixtures having primary and secondary lamps mounted within a light transmissible enclosure of the type described above which permits removal and replacement of the primary and secondary lamps while concurrently supporting the enclosure.

Another object of the present invention is to provide a support assembly for suspended lighting fixtures having primary and secondary lamps mounted within a light transmissible enclosure of the type described above which permits the primary and secondary lamps to be rigidly mounted and selectively spaced for proper thermal and mechanical operation. The assembly also permits the secondary lamp to be movable to a maintenance position in close proximity to the primary lamp such that the primary and secondary lamps can be replaced and removed through a small aesthetically pleasing opening in the enclosure.

Another object of the present invention is to provide a support assembly for suspended lighting fixtures having one or more lamps mounted within a light transmissible enclosure of the type described above in which the enclosure is supported when detached from the assembly during lamp removal and replacement.

These and other objects, features, and advantages of the present invention are readily apparent from the following detailed description of the best mode for carrying out the invention when taken in conjunction with the accompanying drawings.

BEST MODE FOR CARRYING OUT THE INVENTION

With reference to the above drawings, the preferred embodiments of the present invention will be described.

Figure 1:
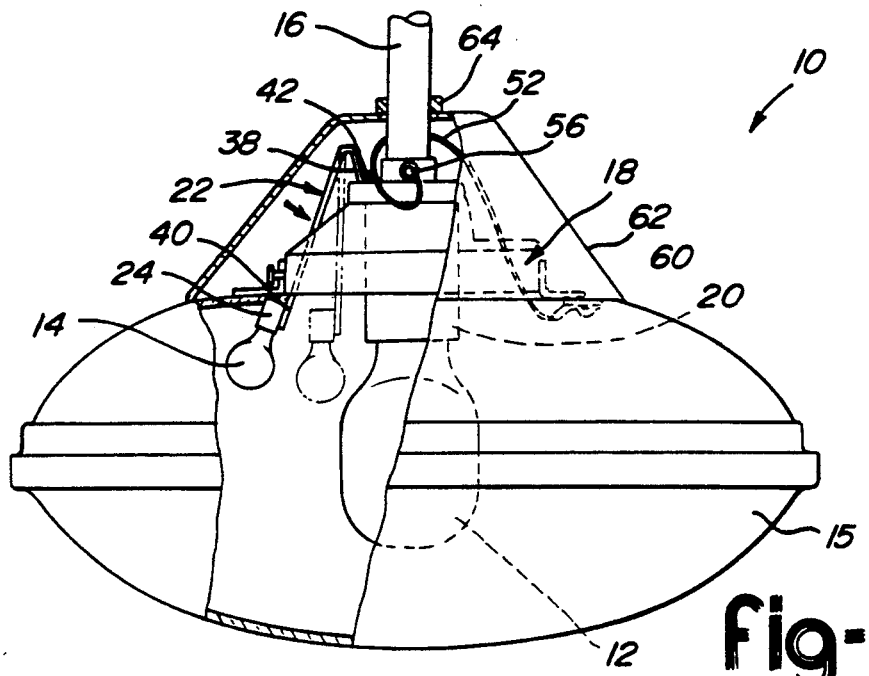
FIG. 1 is a side elevational view of the support assembly of the present invention shown with a light transmissible enclosure in partial cross-section.
Figure 2:
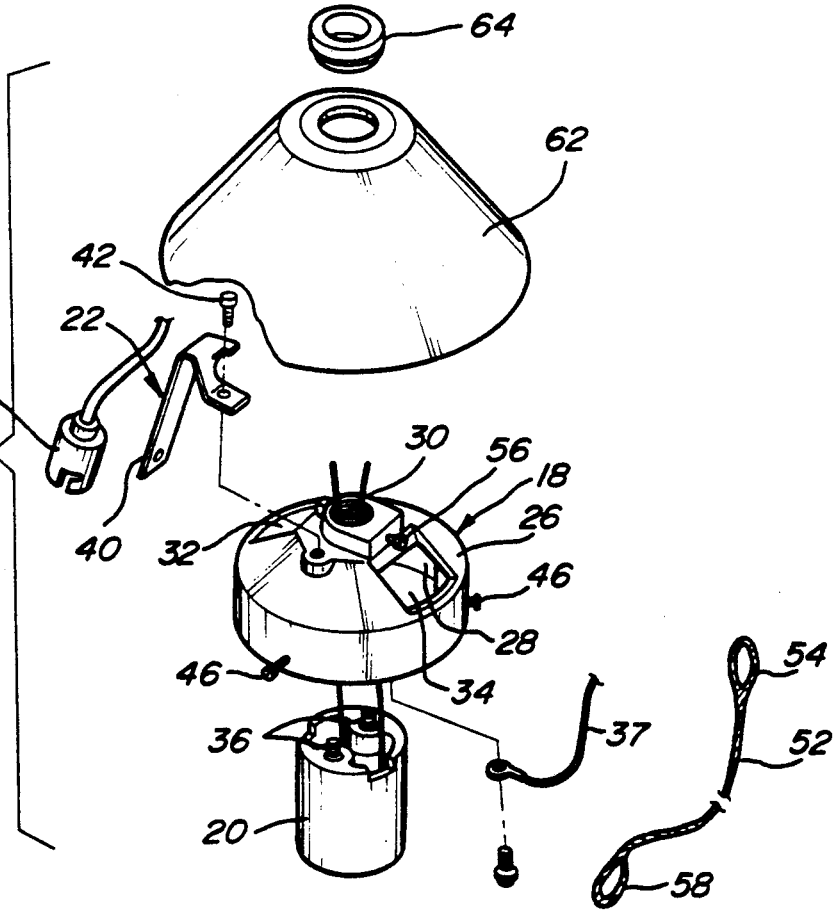
FIG. 2 is an exploded perspective view of the support assembly of the present invention shown with the primary and secondary lamps disconnected and without the light transmissible enclosure.
Figure 3:
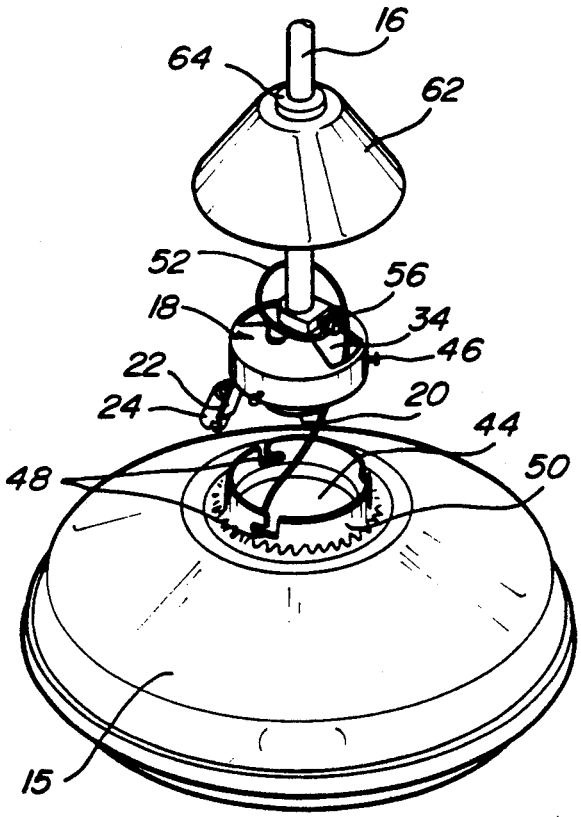
FIG. 3 is a perspective view of the support assembly of the present invention shown with the light transmissible enclosure supported during lamp maintenance.

Referring to FIGS. 1-3, there is shown the lighting fixture support assembly of the present invention generally designated by reference numeral 10. Support assembly 10 is designed to support lighting fixtures such as those suspended from drop ceilings and other overhead structures during lamp removal and replacement. These lighting fixtures often have stand-by lighting capability and thus include a primary lamp 12 and a secondary lamp 14 mounted within a housing such as detachable light transmissible enclosure 15.

Still referring to FIGS. 1-3, primary lamp 12 is preferably a high intensity discharge (HID) lamp such as a mercury, metal halide, high pressure sodium, or low pressure sodium lamp. Because HID lamps suffer from inherent restart delays due to their design, secondary lamp 14 is preferably a tungsten halogen incandescent lamp with quick response time, for use when power to primary lamp 12 is interrupted. It is well known in the art that even a momentary interruption in power can cause primary lamp 12 to become temporarily inoperable. Thus, secondary lamp 14 is designed to become active in these situations until primary lamp 12 restrikes and returns to full operating power.

Referring to FIGS. 1 and 2, support assembly 10 comprises a stem 16, a primary bracket 18, a primary socket 20, a secondary bracket 22, and a secondary socket 24. Primary bracket 18 is preferably bowl-shaped, and has a first side 26, an opposite second side 28, a central bore 30, and two opposed openings 32 and 34 therethrough spaced around the central bore 30.

The stem 16 is designed to suspend from a ceiling mounted electrical junction box and is threadingly received in the central bore 30, serving thereby to suspend assembly 10 from the ceiling. The upper end of the stem 16 may be affixed to a mounting structure such as the remote recessed ballast assembly described in copending application Ser. No. 7/842,454, now U.S. Pat. 5,174,642 assigned to the assignee of the present invention and concurrently filed herewith.

Referring still to FIGS. 1 and 2, primary socket 20 is affixed to the second side of the primary bracket 18 by screws 36. The wiring for primary socket 20, including a ground lead 37, extends through bore 30 in the primary bracket 18, and also through the center of stem 16, to the junction box in the ceiling. The bottom of the primary socket 20 is a conventional HID type such that the primary socket 20 is adapted to electrically and mechanically receive the HID lamp 12.

Referring now to FIG. 2, secondary bracket or strap 22 is shown having a first end 38 and a second end 40. The first end 38 of the secondary bracket 22 is preferably affixed to the first side 26 of the primary bracket 18 by screw 42. Secondary bracket 22 extends through one of the openings 32 such that its second end 40 terminates below primary bracket 18. The secondary socket 24 is affixed to the second end 40 of secondary bracket 22 by a welding process or other suitable affixing means. Like primary socket 20, the secondary socket 24 is adapted to electrically and mechanically receive the secondary lamp 14.

In accordance with the invention, primary bracket 18 establishes a projected perimeter, which is hereby defined as that portion of space that would be in the shade if a bright light was shined on primary bracket 18 from directly above, or alternatively that portion of space above primary bracket 18 if the light was shined from below. This definition assumes that no holes such as openings 32 or 34 are formed through the primary bracket 18. Secondary bracket 22 is preferably made of a flexibly resilient material, such that its second end 40 is mechanically movable between the operating position to which it is normally biased and an operator-induced maintenance position. In the operating position, second end 40 of secondary bracket 22 extends outside the projected perimeter of the primary bracket 18. However, in the maintenance position, second end 40 of secondary bracket 22 is held within the projected perimeter of primary bracket 18.

Referring now to FIG. 3, in the preferred embodiment, enclosure 15 is shown including a central aperture 44 which defines a projected outline below the aperture 44. The phrase "projected outline" here refers to that portion of space which would be in the light if a light were shined through the aperture 44. The enclosure 15 is removably affixable to primary bracket 18 by three mounting screws 46 which engage notches 48 on the flanged rim 50 of the aperture 44 when enclosure 15 is rotated counterclockwise as viewed from above. Alternatively, enclosure 15 can be mounted to one or more of the other components of the fixture assembly such as primary socket 20, secondary bracket 22 and secondary socket 24.

As shown in FIG. 1, in normal operation, primary lamp 12 and secondary lamp 14 are rigidly mounted and spaced apart in accordance with mechanical and thermal operational requirements known to those skilled in the art. In this position, second end 40 of secondary bracket 22 extends generally outside the projected outline of aperture 44. When maintenance is required, such as removal or replacement of primary lamp 12 or secondary lamp 14, the user may apply a counterforce to second end 40 of secondary bracket 22 such that secondary socket 24 and thus secondary lamp 14 are held in close proximity to primary lamp 12. In this operator-induced maintenance position, shown in phantom in FIG. 1, the second end 40 of secondary bracket 22 terminates generally inside the projected outline of aperture 44. In the maintenance position, lamps 12 and 14 and their respective sockets 20 and 22 have a combined a cross-section small enough to pass through aperture 44 of enclosure 15. The primary and secondary lamps 12 and 14 are thus easily extracted from within their enclosure 15 and made accessible for removal, replacement or other repair.

Attention is further directed to FIG. 3 wherein cable 52 is shown attached between primary bracket 18 and enclosure 15 for supporting the enclosure 15 during maintenance. At one end, cable 52 includes a loop 54 that is secured to the first side 26 of primary bracket 22 by a screw 56. The cable 52 passes around the stem 16 and down through the opening 34, and its other looped end 58 is secured to the enclosure 15 by a similar screw 60 or other equivalent means. This arrangement permits the cable 52 to remain concealed under a bracket cover 62 during normal operation. Additionally, the arrangement of the cable 52 and its mounting permits the cable to automatically position itself within the lighting fixture without contacting either lamp. This self-positioning feature of cable 52 prevents thermal damage to the primary and secondary lamps 12 and 14 during operation and maintenance. While a flexible cable such as that disclosed is preferred to support enclosure 15, those skilled in the art will appreciate that an appropriate wire, chain or bracket may, of course, be substituted for and perform the same function as self-feeding, self-positioning cable 52.

In the preferred embodiment, bracket cover 62 is slidably mounted on stem 16 to abut the top of enclosure 15 and shield primary bracket 18 and the other internal components from view and external contact during normal operation. Importantly, bracket cover 62 may still be moved during maintenance to a non-obtrusive position which will not interfere with the lamp removal or replacement process. A grommet 64 is also provided on stem 16 to seal the upper end of bracket cover 62 to stem 16 and to support the bracket cover 62 in the non-obstructive position during the lamp removal and replacement process.

It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

What is claimed is:

1. A support assembly for a lighting fixture having a primary lamp and a secondary lamp mounted within an enclosure, the assembly comprising:

a primary bracket affixable to the enclosure, the primary bracket defining a projected perimeter;

a primary socket affixed to the primary bracket, the primary socket being adapted to electrically receive the primary lamp;

a secondary socket adapted to electrically receive the secondary lamp; and a secondary bracket having a first end affixed to the primary bracket and a second end affixed to the secondary socket, the second end being movable between an operating position wherein the secondary lamp extends outside the projected perimeter of the primary bracket, and a maintenance position wherein the secondary lamp is within the projected perimeter of the primary bracket, such that the primary and secondary lamps may be easily extracted from their enclosure.

2. A support assembly as in claim 1 further comprising means for supporting the enclosure when the enclosure is not affixed to the primary bracket.

3. A support assembly as in claim 2 wherein the means for supporting the enclosure comprises a cable attached between the primary bracket and the enclosure.

4. A support assembly as in claim 3 wherein the cable is self-positionable within the lighting fixture to prevent thermal damage to the primary and secondary lamps during operation and maintenance.

5. A support assembly as in claim 1 wherein the second end of the secondary bracket is normally biased to the operating position.

6. A support assembly as in claim 1 further comprising means for suspending the assembly from an electrical junction box.

7. A support assembly as in claim 6 wherein the means for suspending the assembly from an electrical junction box comprises a stem having a first end adapted to be supported in the electrical junction box and a second end affixed to the primary bracket.

8. A support assembly as in claim 7 further comprising a cover mounted on the stem, the cover shielding the primary bracket from view and external contact during normal operation.

9. A support assembly as in claim 8 wherein the cover is slidably mounted on the stem.

10. A support assembly as in claim 1 wherein the primary lamp is a high intensity discharge lamp.

11. A support assembly as in claim 1 wherein the secondary lamp is an incandescent lamp.

12. A support assembly for a lighting fixture having a primary lamp and a secondary lamp mounted within a detachable light transmissible enclosure and suspended from an overhead electrical junction box, the assembly comprising:

a stem having a first end adapted to be supported in the junction box and a second end;

a primary bracket affixed to the second end of the stem and removably affixed to the enclosure, the primary bracket having a first side, a second side, at least one opening therethrough and a projected perimeter;

a primary socket affixed to the second side of the primary bracket, the primary socket being adapted to electrically receive the primary lamp;

a secondary socket adapted to electrically receive the secondary lamp;

a secondary bracket extending through the opening in the primary bracket, the secondary bracket having a first end affixed to the first side of the primary bracket and a second end affixed to the secondary socket, the second end being normally biased to an operating position wherein the secondary lamp extends outside the projected perimeter of the primary bracket, the second end being movable to a maintenance position wherein the secondary lamp is within the projected perimeter of the primary bracket, such that the primary and secondary lamps may be extracted from their enclosure;

a cable attached between the primary bracket and the enclosure for supporting the enclosure when the enclosure is detached from the primary bracket, the cable being self-positionable within the lighting fixture to prevent thermal damage to the primary and secondary lamps during operation and maintenance; and a cover slidably mounted on the stem to shield the primary and secondary brackets from view and external contact during normal operation.

13. A support assembly for a lighting fixture having a primary lamp and a secondary lamp, the assembly comprising:

a primary bracket;

an enclosure for the primary and secondary lamps, the enclosure being affixable to the primary bracket and including an aperture which defines a projected outline;

a primary socket affixed to the primary bracket, the primary socket being adapted to electrically receive the primary lamp;

a secondary socket adapted to electrically receive the secondary lamp; and a secondary bracket having a first end affixed to the primary bracket and a second end affixed to the secondary socket, the second end being movable between an operating position wherein the second end terminates generally outside the projected outline of the aperture, and a maintenance position wherein the second end terminates within the projected outline of the aperture.

* * * * *